United States Patent [19]

Traficante

[11] 4,185,832

[45] Jan. 29, 1980

[54] POSITION MATCHING BOARD GAME APPARATUS

[76] Inventor: Michael G. Traficante, 12031 Student Dr., Apt. C-18, Orlando, Fla. 32807

[21] Appl. No.: 930,369

[22] Filed: Aug. 2, 1978

[51] Int. Cl.[2] ..... A63F 3/00

[52] U.S. Cl. ..... 273/237; 273/265; 273/243

[58] Field of Search ..... 273/238, 237, 265, 243, 273/1 T

[56] References Cited

U.S. PATENT DOCUMENTS

| | | | |
|---|---|---|---|
| 3,085,803 | 4/1963 | Krzes | 273/238 |
| 3,343,840 | 9/1968 | Winters | 273/265 |
| 3,376,041 | 4/1968 | Anderson | 273/238 |
| 3,404,889 | 10/1968 | Warner | 273/265 |
| 3,537,708 | 11/1970 | Carr | 273/238 |
| 3,640,536 | 2/1972 | Godmer | 273/238 |

FOREIGN PATENT DOCUMENTS

| | | | |
|---|---|---|---|
| 1151351 | 5/1969 | United Kingdom | 273/237 |

*Primary Examiner*—Richard J. Johnson
*Assistant Examiner*—R. Carl Moy
*Attorney, Agent, or Firm*—Costas S. Krikelis

[57] ABSTRACT

A pursuit game apparatus which includes a board divided into two segments in visual isolation of each other, each segment having a plurality of electrical connectors thereon within a design pattern and a moveable probe, with both the design and connector location being identical in each segment. Each connector on one segment is electrically connected to a connector in the corresponding location on the other segment. An electrical power supply and an indicator connected in series with the probes produce a signal indicative of positioning of the two probes in identical complementary connectors in each segment. A die and instruction card means restrict the movement and location of each probe introducing a variation of the pure chance element in the position matching process.

6 Claims, 3 Drawing Figures

POSITION MATCHING BOARD GAME APPARATUS

BACKGROUND OF THE INVENTION

This invention relates to amusement device or game and more particularly to an electrically operated device which visually or audibly indicates the completion of an act.

This invention concerns a game of pursuit, where the position of a probe on a section of a board is tracked by manipulating a complementary probe on a second section of the board. Each probe is controlled by a different player, and the movements of each probe are hidden from the view of the opposing player. Means are provided to indicate when the probes have been placed in corresponding identical positions on either section of the board indicating that the pursuer has captured its prey.

Generally speaking, games of pursuit are well known in the art. It is known, for instance, to provide a board game on which shorting pins in the form of small boats are inserted into connectors on a board face having complementary designs on either side of a view-blocking board in an effort to obtain coincidence of position. The connectors on the board are interconnected through a resistance network which also forms part of an oscillator circuit such that as the boats on either side approach the same location a continuously emitted audio signal changes pitch or other characteristic. This game is quite complex and requires a substantial amount of skill in its execution.

It is also known in the art to have a position matching or number matching game where a number selected on one board must be matched by a number selected on another through closure of a switching network. Thus, a number selected on one board must be guessed by the player operating a second board interconnected to the first. Indicators are provided to show correct or erroneous guess. In a variation of the above, pins may be inserted in one side of a double-faced board and a second player may try to match his position through insertion of pins on the other side. When two pins are inserted in the same position from both sides of the double-faced board, the pins act to complete the electrical circuit and indicate a match. The nature of those games is such that pure chance is involved in completing a match, or in the alternative, it is suggested that clues be given so that through intellectual deduction a match may be achieved.

It has now been found that a game of pursuit may be made quite exciting to play without need of high skill, yet without appearing to be a game of pure chance. Thus, it has been found that if the pursuer and pursued in such a game are given certain instructions, objectives or restrictions in their possible choice of movements, the element of pure chance is modified and the interest of the players in the game greatly enhanced. This is especially so if the instructions given to at least one of the players are not known to the other.

SUMMARY OF THE INVENTION

According to this invention, there is provided a game apparatus comprising a baseboard on which there is demountably mounted a view-blocking means to separate the baseboard into a first and second substantially equal in size sections. On the surface of said first and second sections, there are design means subdividing each section into a plurality of spaces, interconnecting openings and passageways. The design means are complementary in each section, so that for every space, opening and passageway on the first board section there is a corresponding space, opening and passageway on the second.

Within the subdivided spaces, openings and passageways on the baseboard, there is placed a plurality of circuit terminal connectors, each of the connectors defining a position in the first section of the board corresponding to an identical position defined by a connector in the second section of the board to form a complementary pair, and each of those complementary pair of connectors is electrically interconnected.

There are further comprised at least two electrical probes, one on each of the first and second board sections, for mating with the electrical connectors thereon. Electrical conductive means connect the probes to a source of electrical energy in series with the source and an electrical circuit closure indicator, whereby when at least one probe on each of the first and second sections of the board has been inserted into a complementary pair of connectors there is an electrical circuit completion actuating the indicator means. There is also included a set of instruction cards having a primary and a secondary surface, the secondary surface of all cards being identical and the primary surface bearing instructions regulating the location and relocation of at least one of said probes and a chance numerical designator means alternatively regulating the change of position of each of the probes.

It is also within the objective of this invention to provide for more than one probe in one of the board sections, all of the probes on one side connected in parallel, the combination then connected in series with the power source, the probe on the other section, and the indicator means.

An alternate form of this invention may further comprise a board as described above wherein at least one connector of a complementary connector pair on one section of the board is selectively connected electrically to the power source in series with a second electrical indicator whereby the insertion of the probe in the complementary connector of the pair selectively connected to the power source on the other section of the board will actuate the second electrical indicator.

DESCRIPTION OF THE PREFERRED EMBODIMENT

Figure 1:
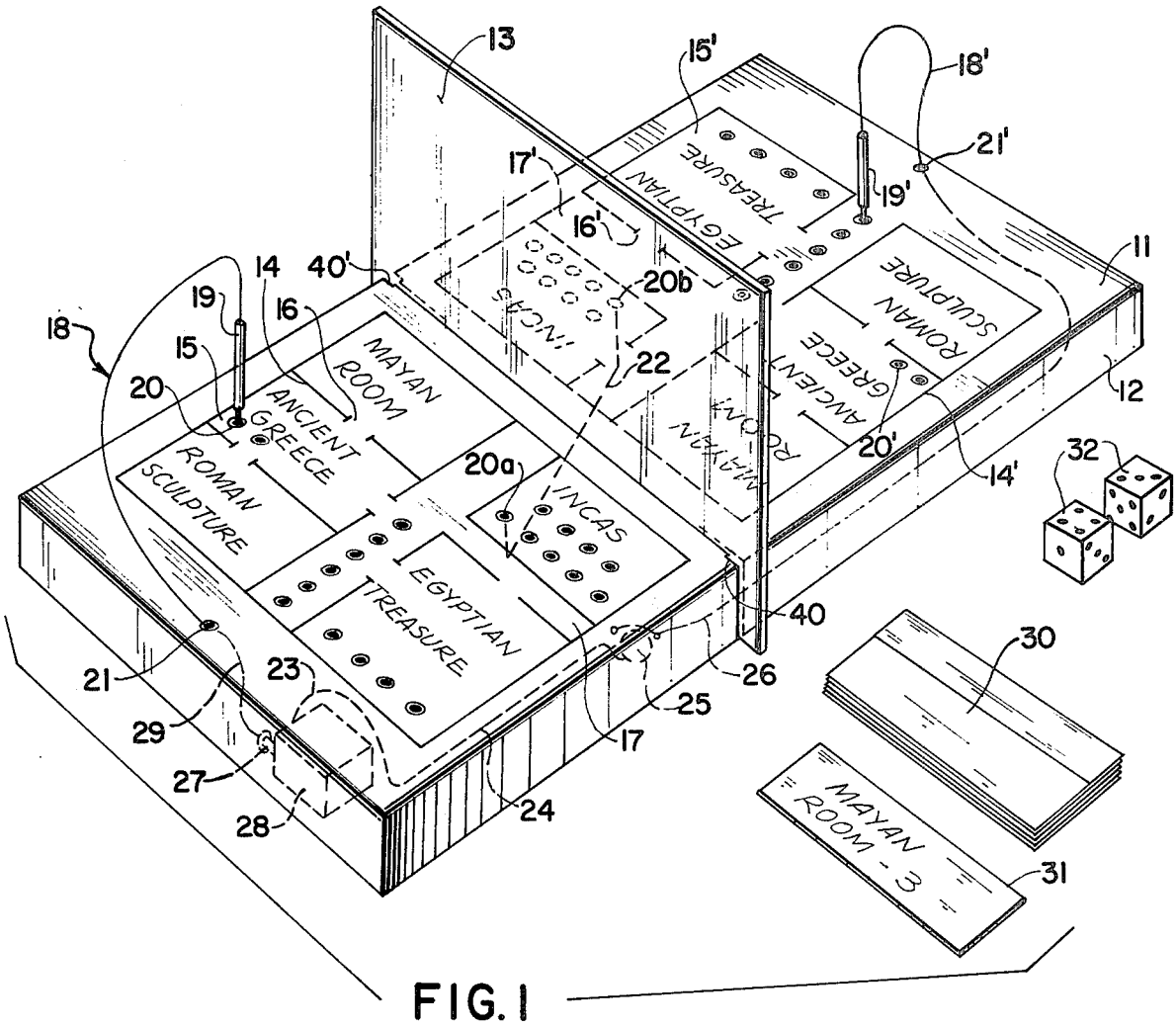
FIG. 1 is a three-dimensional schematic representation of an embodiment of this invention showing the baseboard, probes, connectors and view-blocking means.
Figure 2:
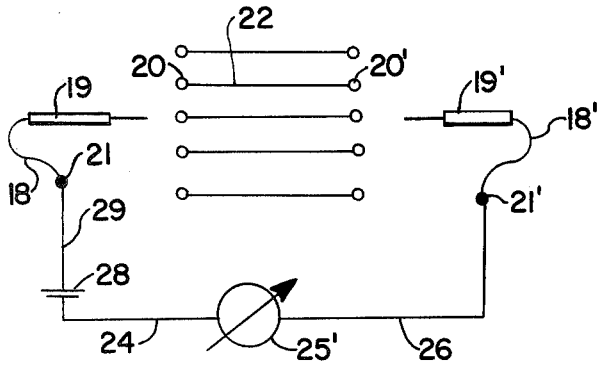
FIG. 2 is a schematic of the electrical circuit showing the connectors required for a limited number of connectors.

Referring to the drawings and more particularly to FIG. 1, the game board apparatus comprises a baseboard 11 mounted on a supporting structure 12 to provide a raised platform. An opaque view-blocking board 13 is demountably mounted by insertion into slots 40 and 40' along the sides of the baseboard across the baseboard in such a way as to block the view of the design and position of playing elements on one side of the board when viewed from the other. This view-blocking board 13 divides the baseboard into first and second sections. Each section of the board bears a design 14 and 14' which subdivides each section of the board into smaller sections 15 and 15'. The design also defines passageways 17 and 17' as well as openings 16 and 16' leading through one area to a passageway or to another subdivided section. In the preferred embodiment, the design 14 and 14' may represent a floor plan of an Archeological Museum. The subdivided sections may be designated for identification by name imprinted thereon as "Mayan Room" or "Incas Room" or "The Egyptian Treasure Room" and so on. As can be seen in the Figure, the two designs are complementary. A player located on one side of the board sees in front of him an identical design as a player located on the other side of the board. However, because of the presence of the view-blocking board, he cannot observe the remainder of the baseboard. On the baseboard, within the design pattern, there are located a multiplicity of electrical, preferably female, connectors 20 and 20'. These connectors are selected to mate with electrical probes 19 and 19' to provide an electrical contact. The probe 19 is connected to a flexible, electrically conductive insulated wire 18 to connecting point 21 located on one end portion of the baseboard. Therefrom underneath the board through electrical connecting wire 29, it is connected to one of two electrical power source terminals 27. An electrical source, which may be a battery 28, is also provided on the underside of the board. The other terminal 23 of the electrical source is connected through wire 24 to an indicator 25 which in the preferred embodiment is in the form of an electrically actuated bell. Bell indicator 25 through electrical connection 26 is connected to connecting point 21' on the other end of the baseboard whereby through flexible conductive wire 18' is connected to the second probe 19'. While a limited number of electrical connectors 20 is shown in FIG. 1, this is only in order to avoid unduly complicating the drawing and rendering it unclear. In the actual board, there are electrical connectors all over the design within the designated areas as well as in the passageways and through the openings. They are preferably located at a short distance from each other in a generally rectangular cross-hatch pattern along lines parallel to the board sides at distances which may be one-half inch (½") apart. This way, the probes 19 and 19' can be moved point by point, that is, connector by connector all over within a room and therefrom through the openings and the passageways to another room. The distance stated is, of course, not limiting, and it is within the invention scope to use any other spacing that will provide a multiplicity of positions for each probe within the designated areas. As indicated, each of those electrical connectors is interconnected through an electrical connection to its corresponding connector on the other side of the board. Only one such connection is shown on this drawing, again in order to simplify the design. Thus, in FIG. 1 electrical connector **20*a* is shown through a dotted line 22 representing an electrical wire connected to electrical connector 20*b* on the other side of the board. In operation, when probe 19 is inserted in electrical connector 20*a* and probe 19' is inserted in electrical connector 20*b*, an electrical circuit is completed whereby current flows from terminal 27 of the power source 28 through electrical conductors 29, 18, 19, 22, 19', 18', 26, electrical bell indicator 25 and electrical conductor 24 to the power source terminal 23 causing bell indicator 25 to emit a sound indicating that the position of probe 19 has been matched by the probe 19'. FIG. 2 shows the details of the electrical circuit used in the preferred embodiment. A number of electrical connectors shown by numerals 20 and 20' corresponding to connectors on either side of the board are interconnected through electrical connections 22. Probe 19 through flexible wire 18 and conductor 29 is indicated as connected to one side of an electrical battery 28 while the other side of this battery through electrical wire 24 is connected to one side of the indicator 25' which can be a meter, a light, a bell or any other type of signalling device operated electrically. The other side of this electrical indicator through electrical conductor 26 and flexible conductor 18' is connected to the probe 19'. As can be seen in FIG. 2, when 19 and 19' are inserted in complementary connectors 20 and 20', a circuit closure will occur and the indicator 25' will produce some indication advising the players that the match has been accomplished. In operation, at least two more elements are needed to complete the present game; a set of commonly used die shown by numeral 32 in FIG. 1 and at least one set of instruction cards shown as 30 and 31 again in FIG. 1** to be described more fully thereafter.

In the preferred embodiment, the designations on either side of the divided board represent a floor plan of the museum. While not necessarily so, it is contemplated that probe 19 will represent a thief while probe 19' will represent a museum guard. The purpose of the game is for the museum guard to catch the thief before the thief can accomplish a theft in the museum. The game may begin with both players placing their probes in a connector within the floor plan of the museum. Then the player representing the thief draws one of the over-turned cards 30 and privately reads the instructions imprinted thereon. As shown in FIG. 1, the instructions may indicate a room and a numeral. More particular, the instruction cards may resemble a deck of common playing cards, having a common design or color imprinted on one side. On the other side, there is imprinted instructions which, in one embodiment, indicate the name of one of the museum rooms followed by a numeral which may vary from two (2) to twelve (12) if two dice are used, or one (1) to six (6) if only one die is provided. Thus, if there are five (5) rooms shown in the museum floor plan, there would be thirty (30) cards if one die is used and fifty-five (55) instruction cards if two dice are provided. Of course, fewer instruction cards may be used if so desired; however, the number selected should be sufficient to provide a high degree of variation in the room/number combinations possible.

Having read his instruction card, the player will try to move the probe position by position as defined by the connectors through the openings and passageways provided until he reaches his objective, that is, the room mentioned in the card.

At the same time, the player representing the guard will move his probe unit by point trying to obtain a position match with the thief and thus win the game. Each player may move his probe as many positions as indicated by the numeral shown through the throw of the dice. Each player takes turns tossing the dice and moving the probe. Once the thief has reached the designated room, he may or may not, depending on the particular game rule decided upon by the players beforehand, indicate to the other player that he has reached his objective. Once in this room, the thief will have to stay within that area and roll the dice until the indicated number on the dice matches the numeral shown on the card he had originally selected. The guard at the same time will continue trying to locate the thief before the thief can obtain the designated dice number and win the game. In the preferred embodiment of the game, two sets of instruction cards are employed; one set simply indicates the room which is the objective of the thief while a second one carries a set of numbers. When this embodiment is used, the thief, after reaching the particular room which is his objective, overturns one of the second set of cards and looks at the number indicated thereon. When this embodiment is used, a smaller number of cards is necessary; one set corresponding to the numer of rooms, in this case comprising five cards, the other set corresponding to the possible dice combinations, which, if two dice are used, is eleven cards.

While dice is shown here as being the means used to designate the particular number of positions by which each probe will move at a time, other such means are known in the art, such as a spinning wheel with numbers designated thereon, or electrically moved indicators which will spin for a certain time and designate a particular numeral or combination of numerals at the end of their cycle. The game has been described using a floor plan of a museum. This, however, is not restrictive and similar games may be played using a space and galaxy arrangement where the probes may represent spaceships and the objective may be reaching a certain point in the galaxy, or again the probes may represent a boat smuggling a particular contraband while a police or a coast guard boat is trying to apprehend the criminals. The probes themselves may be shaped to match the particular needs of the game and represent figurines of a thief and a guard, etc.

Figure 3:
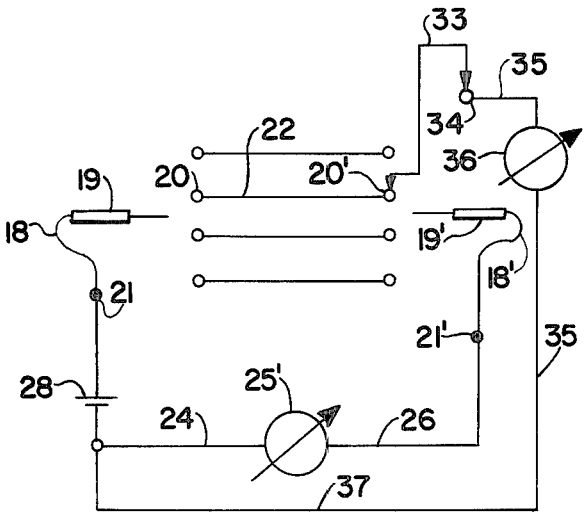
FIG. 3 is a schematic of the electrical circuit used when two electrical indicators are employed.

In an alternate embodiment of this invention, it is contemplated using a circuit of the type disclosed in FIG. 3. In this instance, an additional indicator is provided on one side of the board connected to the electrical power source 28 through an electrical connector 37. This additional indicator 36 may be an indicator light located on one corner of the playing board visible only from the side which corresponds to the guard's side and connected to a connecting point 34 outside the playing area of the board. A double pin interconnected through a wire 33 may be used to connect any of the connectors 20' to connecting point 34. Thus, an alarm, which is preferably silent, has been established which will indicate to the guard the passage of the thief through a particular point. That point is selectable at will by the guard and may change from game to game. If so desired, it is also possible to use a bell for this alarm to indicate to both players that the thief has tripped it.

Naturally, within the scope of this invention is the possibility of using multiple guard probes where they would all be connected in parallel to connecting point 21'. Additionally, multiple silent alarms may be used rather than one as shown before, and it is also possible to use more than one thief in the form of a multiplicity of probes connected on the other side of the board. The materials of construction are of no particular importance, and any structurally strong enough substance to provide a base on which electrical connectors may be mounted is acceptable. In the preferred emobdiments, a plastic sheet with imprinted insignia is preferred as it assures good electrical insulation between connectors and allows the use of inexpensive connectors. Either hard wiring or printed circuit board means may be used. A wooden structural support may be used for supporting structure 12 to raise the board and provide room under it for the mounting of the wiring, power source and indicator. The dividing board 13 may be mounted by sliding it over two guides on the sides of supporting structure 12. It may be made out of an opaque plastic cardboard or wood or any other material which will provide a visual barrier between the two sides. While slots are presently used, other means to fasten the visual barrier on the playing board are contemplated, such as pegs, screws, or other well-known means in the art. The instruction cards 30 and 31 may be replaced by an electronically controlled indicator, such as used in the games of chance, to obtain a particular indication of the objective, and such well-known elements in the art are contemplated within the scope of this invention.

In the preferred embodiment, a battery is used as the power source. This is not limiting and an alternating or direct current supply, preferably of low voltage, may be used either through the use of a power pack providing a low voltage direct current output or through the simple use of a step-down transformer to decrease the common household voltage from 120 volts to a safe playing level.

I claim:

1. A game apparatus comprising:

(i) a baseboard;

(ii) view-blocking means mounted on said board dividing said board into first and second sections;

(iii) said first and second sections having design means thereon subdividing each into a pluraity of spaces and interconnecting openings and passageways, each section bearing identical complementary design means whereby for every space opening and passageway on the first board section there is a corresponding space opening and passageway in the second;

(iv) a plurality of circuit terminal connectors located on said baseboard within said subdivided spaces, openings and passageways, each of said connectors defining a position in the first section corresponding to an identical connector position in the second section to form a complementary pair each of said complementary pair of connectors electrically interconnected;

(v) at least two electrical probes one on each of said first and second board sections for mating with the electrical connectors thereon;

(vi) electrical conductive means connecting said probes to a source of electrical energy;

(vii) electrical indicator means connected in series with said electrical energy source and probes whereby when at least one probe on each of said first and second sections of the board has been inserted into a complementary pair of connectors there is an electrical circuit completion actuating said indicator means;

(viii) at least one set of instruction cards having a primary and a secondary surface, the secondary surface of all cards being identical, and the primary surface bearing design means corresponding to one of said plurality of spaces on said first and second boards, said primary surface thereby bearing instructions regulating the location and relocation of at least one of said probes;

(ix) a chance numerical designator means alternately regulating the change of position of each of said probes.

2. The apparatus of claim 1 wherein said electrical indicator means comprise an electrically actuated bell.

3. The apparatus of claim 2 wherein there is comprised a first and a second set of instruction cards each card having a primary and a secondary surface, the secondary surface of each card of each set being identical and the primary surface of said first set bearing instructions regulating the location and relocation of at least one probe and the primary surface of said second set bearing additional instructions defining the chance numerical designator means designation which constitutes a winning combination.

4. Apparatus of claim 2 or 3 where said chance numerical designator comprises a pair of dice.

5. The game apparatus of claim 1 or 3 wherein at least one connector of a complementary pair on said first section of the board is selectively connected to the power source in series with a second electrical indicator whereby insertion of the probe in the complementary connector of said pair selectively connected to the power source on said second section of the board will actuate said second electrical indicator.

6. A claim according to claim 5 wherein said second electrical indicator produces a signal detectable only on said first section of the board.

* * * * *